US005367938A

United States Patent [19]

Hamanaga

[11] Patent Number: 5,367,938

[45] Date of Patent: Nov. 29, 1994

[54] HORN WITH INTERMEDIATE TUBE NETWORK ENLARGED IN INNER DIAMETER

[75] Inventor: Shinji Hamanaga, Shizuoka, Japan

[73] Assignee: Yamaha Corporation, Japan

[21] Appl. No.: 96,021

[22] Filed: Jul. 22, 1993

[30] Foreign Application Priority Data

Jul. 24, 1992 [JP] Japan ..... 4-218398

[51] Int. Cl.[5] ..... G10D 7/10

[52] U.S. Cl. ..... 84/387 R; 84/389; 84/393

[58] Field of Search ..... 84/387 R, 388, 389, 84/390, 393

[56] References Cited

U.S. PATENT DOCUMENTS 4,127,050 11/1978 Takeuchi ..... 84/387 R

*Primary Examiner*—Michael L. Gellner
*Assistant Examiner*—Patrick J. Stanzione
*Attorney, Agent, or Firm*—Ostrolenk, Faber, Gerb & Soffen

[57] ABSTRACT

A full-double French horn comprises a mouth piece, a front tube member, an intermediate tube network associated with valves, a rear tube member and a bell for defining a vibrative column of air, and the inner diameter of the intermediate tube network affects fortissimo sounds and low-pitched sounds, wherein the inner diameter of the intermediate tube network ranges from 12.8 millimeters to 13.5 millimeters so as to improve the fortissimo and low-pitched sounds without sacrifice of timbre and a good feeling in the blowing.

4 Claims, 1 Drawing Sheet

HORN WITH INTERMEDIATE TUBE NETWORK ENLARGED IN INNER DIAMETER

FIELD OF THE INVENTION

This invention relates to a horn and, more particularly, to an intermediate tube network incorporated in the horn.

DESCRIPTION OF THE RELATED ART

A typical example of the horn largely comprises a mouth piece, a front taper tube, an intermediate tube network, a rear taper tube and a bell, and the front taper tube, the intermediate tube network, the rear taper tube and the bell provide a wind passage therein. When a player buzzes in the mouth piece, a column of air defined by the wind passage vibrates, and produces a sound.

The mouth piece is shaped into a funnel, and is coupled with the front end of the front taper tube. The inner wall of the front taper tube defines a bore, and the bore is increased in diameter from the mouth piece.

The intermediate tube network is coupled with the rear end of the front taper tube, and provides two wind sub-passages. Two valves are provided at the inlet and the outlet of the intermediate tube network, respectively, and the valve at the outlet selectively couples the bore of the front taper tube with the two wind sub-passage for changing the key-note. The two wind sub-passages are constant in inner diameter, and ranges from 11.9 millimeters to 12.1 millimeters in diameter. A plurality of valves are provided in association with each of the wind sub-passages, and the player changes the pitch by using these valves.

The valve at the rear end of the intermediate tube network is coupled with the front end of the rear taper tube, and allows the selected wind sub-passage to be conducted with the bore formed in the rear taper tube. The bore in the rear taper tube is increased in diameter from the front end to the rear end thereof.

The bell is coupled with the rear end of the rear taper tube, and diffuses the sound produced through the vibrations of the column of air.

When the player performs a music with the prior art horn, the loudness of sounds is controlled through breathing, and the pitch is changed by using the valves and the buzzing. However, the prior art horn does not satisfy the player because of a narrow dynamic range, and most of players expects the prior art horn to improve fortissimo sounds an low-pitched sounds.

SUMMARY OF THE INVENTION

It is therefore an important object of the present invention provide a horn which produces an improved fortissimo sound and an improved low-pitched sound without sacrifice of timbre and a feeling in the blowing.

The present inventor contemplated the problem inherent in the prior art horn, and found that the inner diameter of the intermediate tube network affected fortissimo sounds and low-pitched sounds. The present inventor repeated trial manufacture, and determined appropriate range of the inner diameter.

To accomplish the object, the present invention proposes to form a wind passage of an intermediate tube within a range between 12.8 millimeters and 13.5 millimeters.

In accordance with the present invention, there is provided a horn for producing a sound through vibrations of a column of air, comprising: a) a mouth piece where a player buzzes; b) a front tube means connected at one end thereof with the mouth piece, and defining a first wind passage increased in diameter from the aforesaid one end toward the other end thereof; c) an intermediate tube means connected at one end thereof with the other end of the front tube means, and defining a second wind passage having a constant diameter ranging from 12.8 millimeters to 13.5 millimeters; d) a rear tube means coupled at one end thereof with the other end of the intermediate tube means, and defining a third wind passage increased in diameter from the aforesaid one end toward the other end thereof; and e) a bell means coupled with the rear tube means, and defining a fourth wind passage for diffusing the sound, the first, second, third and fourth wind passages defining the column of air.

BRIEF DESCRIPTION OF THE DRAWINGS

The feature and advantages of the horn according to the present invention will be more clearly understood from the following description taken in conjunction with the accompanying drawings in which.

DESCRIPTION OF THE PREFERRED EMBODIMENT

Figure 1:
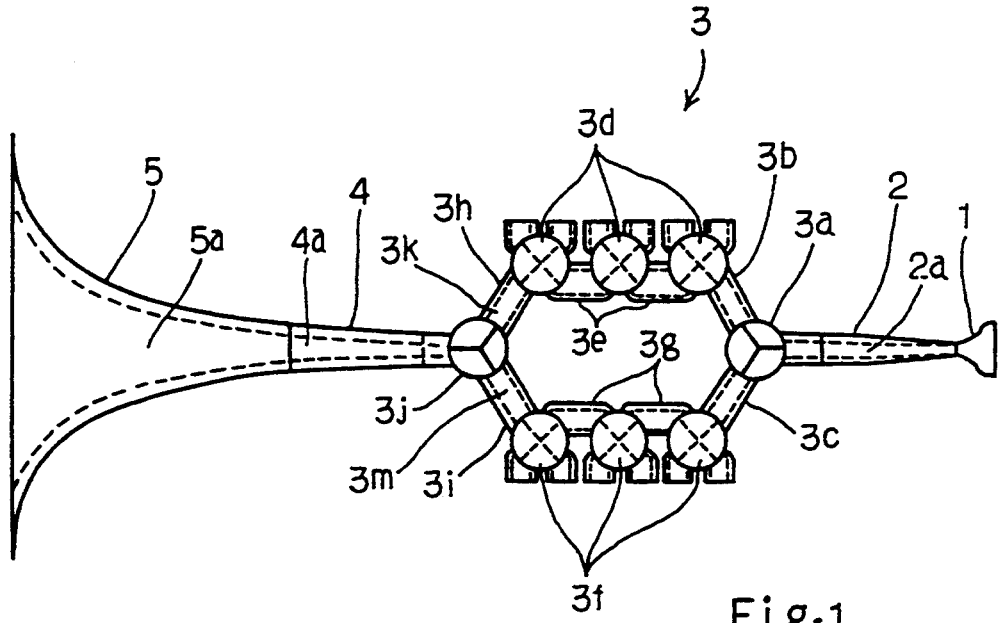
FIG. 1 is a schematic view showing a full-double French horn according to the present invention.

Referring first to FIG. 1 of the drawings, a full-double French horn largely comprises a mouth piece 1, a front tube member 2, an intermediate tube network 3, a rear tube member 4 and a bell 5. The mouth piece 1, the front tube member 2, the intermediate tube network 3, the rear tube member 4 and the bell 5 are formed of brass. However, nickel alloy is available for them. The mouth piece 1, the front tube member 2, the intermediate tube network 3, the rear tube member 4 and the bell 5 are adjusted to 60 millimeters, 500 millimeters, 800 millimeters, 550 millimeters and 850 millimeters in length.

The mouth piece 1 is shaped into a funnel, and is connected with a front end of the front tube member 2. A first wind passage **2*a* is formed in the front tube member 2, and the first wind passage 2*a* is tapered from the front end toward a rear end of the front tube member 2. In other words, the first wind passage 2*a* is gradually increased in diameter from the front end to the rear end. However, the inner wall of the front tube member 2 is constituted by curved surfaces, and, accordingly, the taper non-linearly increases the diameter of the first wind passage 2*a*. The front tube member 2 per se serves as a front tube means in this instance. However, a plurality of tapered tube members may constitute the first wind passage 2*a***.

The intermediate tube network 3 is fabricated from a front change-over valve **3*a*, two front straight tube members 3*b* and 3*c*, a set of valve units 3*d* coupled through interconnecting tube members 3*e*, another set of valve units 3*f* also coupled through interconnecting tube members 3*g* connected with the rear end of the front tube member 2, two rear straight tube members 3*h* and 3*i* and a rear change-over valve 3*j*. The front change-over valve 3*a*** has an inlet coupled with the rear end of the front tube member 2, and the front straight tube members 3*b* and 3*c* are coupled with two outlets of the front change-over valve 3*a*. The set of valve units 3*d* is coupled between the front straight tube member 3*b* and the rear straight tube member 3*h*, and the other set of valve units 3*f* is coupled between the front straight tube member 3*c* and the rear straight tube member 3*i*. The rear straight tube members 3*h* and 3*i* are respectively coupled with two inlets of the rear change-over valve 3*j*, and the outlet of the rear change-over valve 3*j* is coupled with the rear tube member 4.

The front straight tube member 3*b*, the set of valve units 3*d*, the interconnecting tube members 3*e* and the rear straight tube member 3*h* form in combination a wind sub-passage 3*k* therein, and the wind sub-passage 3*k* is constant in diameter. Similarly, the front straight tube member 3*c*, the set of valve units 3*f*, the interconnecting tube members 3*g* and the rear straight tube member 3*i* form in combination another wind sub-passage 3*m* therein, and the wind sub-passage 3*m* is also constant in diameter. The wind sub-passages 3*k* and 3*m* serve as a second wind passage. In this instance, the wind sub-passages 3*k* and 3*m* are equal in diameter to one another, and the constant diameter of each wind sub-passage 3*k* or 3*m* ranges between 12.8 millimeters and 13.5 millimeters.

The wind sub-passage 3*k* is assigned to the key node F, and the other wind sub-passage 3*m* is assigned to the key $B^b$, and a player manipulates the front and rear change-over valves 3*a* and 3*j* so that one of the wind sub-passages 3*k* and 3*m* is conducted between the front tube member 2 and the rear tube member 4. The sets of valve units 3*d* and 3*f* change the pitch of a sound, and the notes progresses along the selected scale by manipulating the set of valve units and buzzing.

A third wind passage 4a is formed in the rear tube member 4, and the third wind passage 4a is tapered from the front end toward a rear end of the rear tube member 4. In other words, the third wind passage 4*a* is gradually increased in diameter from the front end to the rear end. However, the inner wall of the rear tube member 4 is constituted by curved surfaces different in radius, and accordingly, the taper non-linearly increases the diameter of the third wind passage 4*a*. The rear tube member 4 per se serves as a rear tube means in this instance. However, a plurality of tapered tube members may constitute the third wind passage 4*a*.

The bell 5 also defines a fourth wind passage 5*a*, and the fourth wind passage 5*a* is tapered from the front end toward a rear end of the bell 5. In other words, the fourth wind passage 5*a* is gradually increased in diameter from the front end to the rear end. However, the inner wall of the bell 5 is constituted by curved surfaces different in radius, and, accordingly, the taper non-linearly increases the diameter of the fourth wind passage 4*a*. The rear tube member 4 per se serves as a rear tube means in this instance.

Figure 2:
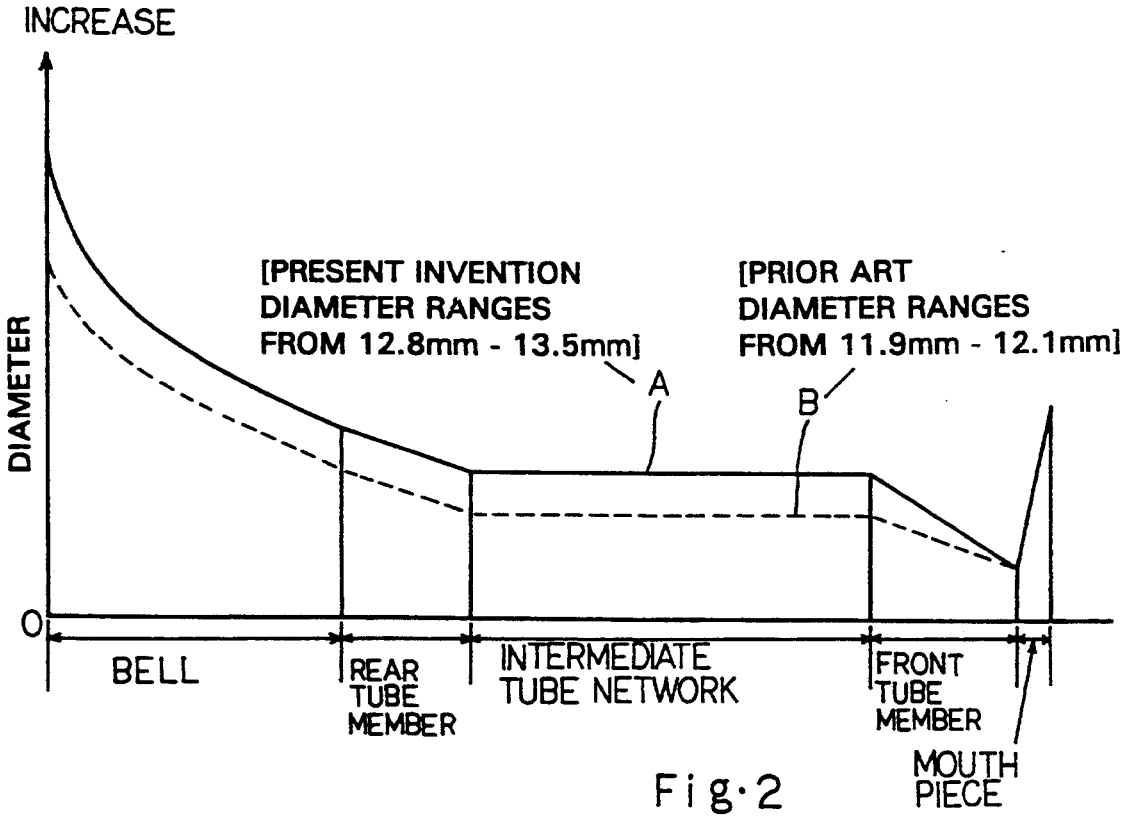
FIG. 2 is a graph showing the inner diameter of a wind passage defined in the full-double French horn according to the present invention as well as the inner diameter of the prior art.

The first wind passage 2*a*, the wind sub-passage 3*k* or 3*m*, the third wind passage 4*a* and the fourth wind passage 5*a* are sequentially conducted, and define a column of air. The radius of the column of air varies as indicated by real line A in FIG. 2, and is larger than the column of air defined in the prior art horn. Broken lines B is indicative of variation of radius of the column of air defined in the prior art horn.

While performing a music, a player busses in the mouth piece 1, and the column of air vibrates. The player varies tension of his lips and manipulates the set of valve units associated with the selected wind sub-passage, and sequentially changes the pitch of the sound therethrough.

The virtue of the enlarged wind sub-passage, fortissimo sounds and low-pitched sounds were improved without sacrifice of the timbre and a good feeling in the blowing. If the diameter of the wind sub-passage 3*b*, 3*e* and 3*k* or 3*c*, 3*e* and 3*m* is less than 12.8 millimeters, the fortissimo sounds are not large enough to be expected, and the low-pitched sounds are unclear, because the amount of vibrative column of air is small. On the other hand, if the diameter of the wind sub-passage 3*b* to 3*k* or 3*c* to 3*m* is greater than 13.5 millimeters, the column of air is too large, and the timbre and the feeling become different and strange.

As will be appreciated from the foregoing description, the horn according to the present invention appropriately enlarges the column of air, and improves fortissimo sound and low-pitched sounds without sacrifice of the timbre and the good feeling.

Although the particular embodiment of the present invention has been shown and described, it will be obvious to those skilled in the art that various changes and modifications may be made without departing from the spirit and scope of the present invention. For example, the present invention is applicable to any type of horn such as, for example, a single horn, a semi-double horn or a triple horn. Moreover, any combination of key notes may be assigned to wind sub-passages of an intermediate tube network, and the wind sub-passage may be different in diameter in so far as the diameters are fallen into the range according to the present invention.

What is claimed is:

1. A horn for producing a sound through vibrations of a column of air, comprising:
   a) a mouth piece where a player buzzes;
   b) a front tube means connected at one end thereof with said mouth piece, and defining a first wind passage increased in diameter from said one end toward the other end thereof;
   c) an intermediate tube means connected at one end thereof with the other end of said front tube means, and defining a second wind passage having a constant diameter ranging from 12.8 millimeters to 13.5 millimeters;
   d) a rear tube means coupled at one end thereof with the other end of said intermediate tube means, and defining a third wind passage increased in diameter from said one end toward the other end thereof; and
   e) a bell means coupled with the other end of said rear tube means, and defining a fourth wind passage for diffusing said sound, said first, second, third and fourth wind passages defining said column of air.

2. A horn as set forth in claim 1, in which said intermediate tube means comprises a plurality of first change-over valves, and defines a plurality of wind sub-passages respectively assigned to key notes and selectively conducted with said first and third wind passages by means of said plurality of first change-over valves.

3. A horn as set forth in claim 2, in which a plurality sets of second valves are respectively provided for said plurality of wind sub-passages for changing the pitch of said sound.

4. A horn as set forth in claim 3, in which said plurality of wind sub-passages are equal in diameter.

* * * * *